US005671728A

United States Patent [19]

Winefordner et al.

[11] Patent Number: 5,671,728

[45] Date of Patent: Sep. 30, 1997

[54] SNORKEL PUMP APPARATUS

[75] Inventors: Carl Winefordner; Frank Hermansen, both of Costa Mesa, Calif.

[73] Assignee: Sheico USA, Carlsbad, Calif.

[21] Appl. No.: 660,852

[22] Filed: Jun. 10, 1996

[51] Int. Cl.[6] ..... A62B 7/62

[52] U.S. Cl. ..... 128/201.11; 128/201.27

[58] Field of Search ..... 128/201.11, 201.27, 128/200.25, 200.23, 200.29, 201.19, 201.28

[56] References Cited

U.S. PATENT DOCUMENTS

| | | | |
|---|---|---|---|
| 4,708,135 | 11/1987 | Arkema | 128/201.11 |
| 5,193,530 | 3/1993 | Gamow et al. | 128/201.27 |
| 5,438,977 | 8/1995 | Gomez et al. | 128/201.7 |
| 5,535,734 | 7/1996 | Lu et al. | 128/201.11 |

FOREIGN PATENT DOCUMENTS

| | | | |
|---|---|---|---|
| 849903 | 8/1939 | France | 128/201.11 |
| 868058 | 2/1953 | Germany | 128/201.11 |

*Primary Examiner*—Vincent Millin
*Assistant Examiner*—William J. Deane, Jr.
*Attorney, Agent, or Firm*—Leonard Tachner

[57] ABSTRACT

A snorkel pump comprising a pair of tubular members, one of which is moveable in coaxial slidable engagement with the other, and both of which are in fluid communication with the remaining length of the snorkel tube. The pump also comprises a pair of one-way valves coaxially spaced depending upon the relative positions of the two tubular members and a spring positioned between the two valves to compressively resist and thus facilitate reciprocal motion of the moveable tubular member relative to the other. Such reciprocal motion creates a suction effect which draws water away from the mouthpiece region and propels it through the two valves and out the bottom end of the snorkel tube. The mouthpiece support is formed as an integral part of one such tubular member which is, in turn, secured axially to the remaining elongated section of the snorkel tube. The moveable tubular member of the pump provides one of the two valves and the other, a fixed tubular member, provides the other of the two valves. The valves may be mushroom flap-type valves which are configured to permit water flow in only a unitary direction away from the mouthpiece and toward the bottom or lower end of the snorkel.

9 Claims, 4 Drawing Sheets

SNORKEL PUMP APPARATUS

BACKGROUND OF THE INVENTION

1. Field of the Invention

The present invention relates generally to snorkel equipment and more particularly to a pump apparatus for snorkel tubes wherein water collected adjacent the snorkel mouthpiece may be readily expelled at the snorkel tube end below the mouthpiece by means of the pump apparatus.

2. Prior Art

Various recent improvements in the configuration of snorkels have been directed toward removing the water that collects within the tube adjacent the mouthpiece and that would otherwise cause a gurgling effect and interfere with normal breathing. However, such improvements tend to be directed to improving simple drainage or to improving the effectiveness of water expulsion by sudden and forced exhalation bursts. Unfortunately, neither drainage nor expulsion can be counted on to always fully remove substantially all water collected adjacent the mouthpiece.

The following U.S. Pat. Nos. appear to be of some relevance to the invention herein:

859,786 Steenerson
908,690 Neubert
2,918,918 Rebikoff
3,659,308 Gute
4,071,024 Blanc
4,241,898 Segrest
4,708,135 Arkema
4,860,739 Vandepol
4,884,564 Lamont
5,261,396 Faulconer et al
5,493,079 Anderson Of the foregoing references, the following appear to be the most pertinent:

U.S. Pat. No. 2,918,918 to Rebikoff is directed to an underwater swimming apparatus that includes a hand pump for evacuating collected gases/moisture. The invention relates to snorkels, masks, and other types of underwater swimming devices. The object of the invention is to provide a manual means for removing water or any other undesirable liquids or gases which may collect in a breathing apparatus. Three embodiments of the pump device are seen in FIGS. 1–3. Using the embodiment shown in FIG. 1 as an example, the pump device comprises a chamber 6 with end walls 5 and 8 and sidewalls being a bellows 7. Pump inlet opening 4 is fitted with inlet valve 9 while the outlet opening 10 is fitted with an outlet flap valve 11. The device is operated by means of ball handle 14. When the handle 14 is pushed in the direction of arrow 13, outlet flap valve 11 is opened and collected moisture in chamber 6 is forced out. When the handle 14 is moved in the direction of arrow 12, a vacuum is created within chamber 6 which causes the inlet valve 9 to open and collected moisture/gas moved into chamber 6. No spring is disclosed for resisting reciprocal motion of the handle 14.

U.S. Pat. No. 5,261,396 to Faulconer et al is directed to a divers' snorkel purge reservoir which is a chamber extending away from the mouthpiece of a snorkel tube. By eliminating baffles and various conduits that have previously been used, the device allows for purging the collected water and for an enhanced breathing capability. Referring to the Figure, the purge chamber 74 has an enlarged purge opening 84 with a flapper valve 94 made of an elastomeric material. The valve 94 has a valve seat 110 which prevents the inlet of water into the purge chamber 84 which allows for the purge of water and air when opened in the direction of arrow P. This device does not use a purge pump, but depends upon the increase in pressure from the mouthpiece which opens the valve 94 in the direction of arrow P and allows the passage of air and trapped water from chamber 84 to be blown therefrom.

U.S. Pat. No. 4,241,898 to Segrest is directed to a purge valve for diver's masks. The manually operable purge valve is indicated with the numeral 10 in the Figures and comprises a circular base member 14 extending through an opening in the wall of face mask 12. A plurality of passages 20 extend through the member 14 and open through a valve seat surface 14*c* surrounding the rod-like stem 22. The valve member 30 is mounted on stem 22 for manual operation. In operation, the diver manually pulls valve member 30 away from base member 40 against the action of spring 50. Thus, water is drained or expelled through passages 20 to the outside as shown by the arrow 52. When the diver releases the valve member 30, the system is returned by spring tension sealing the ends of passages 20.

U.S. Pat. No. 4,708,135 to Arkema is directed to a snorkel which includes a resilient container at the bottom thereof in order to collect any fluid entering the snorkel. The container may be emptied by manually collapsing it. Referring to FIG. 1, the snorkel 1 with breathing tube 2 is seen with a U-shaped member 4 wherein water collects. At the bottom of U-shaped member 4, there is provided a bulb or container 12 which serves to collect the water entering the snorkel 1. When container 12 fills with liquid, the swimmer may manually compress container 12 in order to expel its contents into the U-shaped member 4. The swimmer then exhales with some force, to cause the water to be expelled through the breathing tube 2. A second embodiment is seen in FIG. 2.

U.S. Pat. No. 859,786 to Steenerson is directed to a swimming mask that includes a cavity or depression for collection of water within the device. Referring to the Figures, the cup-shaped cavity 8 is seen with flexible diaphragm 11 and aperture 12 through which the water may pass. When the swimmer works the lower jaw, the diaphragm 11 is forced in a downwardly direction which causes the stem 14 to operate valve 13 to close the aperture 12 and expel the water from cavity 8 through aperture 9. The resiliency of the diaphragm 11 restores it to its normal position.

U.S. Pat. No. 908,690 to Neubert is directed to diving gear that includes a trap for accumulating moisture which may be discharged by the diver while he is submerged. Referring to FIG. 3, the trap D may be discharged by using pump p which is secured to the underside of the trap. The pump is provided with an inlet flap valve q, a piston r, and a valve r' with a suitable spring S being provided to maintain the piston in its upper position. As the piston is moved downwardly, the valve q opens and permits the water to flow into the cylinder above the piston, and as the latter is moved upwardly, the valve q closes and the valve r' opens so that the water passes beneath the piston. Thus, the diver is able to force the accumulated liquid from the trap and maintain the apparatus in a water-free condition.

SUMMARY OF THE INVENTION

The present invention provides an aggressive new approach to removing substantially all water collected within a snorkel tube adjacent the mouthpiece. It does so without relying on drainage or on lung-forced expulsion. The invention consists of a snorkel pump comprising a pair of tubular members, one of which is moveable in coaxial slidable engagement with the other, and both of which are in fluid communication with the remaining length of the snorkel tube. The pump also comprises a pair of one-way valves coaxially spaced depending upon the relative positions of the two tubular members and a spring positioned between the two valves to compressively resist and thus facilitate reciprocal motion of the moveable tubular member relative to the other. Such reciprocal motion creates a suction effect which draws water away from the mouthpiece region and propels it through the two valves and out the bottom end of the snorkel tube.

In a preferred embodiment, the mouthpiece support is formed as an integral part of one such tubular member which is, in turn, secured axially to the remaining elongated section of the snorkel tube. The moveable tubular member of the pump provides one of the two valves and the other, a fixed tubular member, provides the other of the two valves. The valves may be mushroom flap-type valves which are configured to permit water flow in only a unitary direction away from the mouthpiece and toward the bottom or lower end of the snorkel.

OBJECTS OF THE INVENTION

It is therefore a principal object of the present invention to provide a unique snorkel which employs a manually-actuatable pump to suction substantially all collected water away from the mouthpiece and out of the snorkel.

It is another object of the invention to provide a pump for removing water from a snorkel tube and which is aesthetically compatible with the snorkel tube.

It is still another object of the invention to provide a pump for removing water from a snorkel tube and which is ergonomically adapted for ease of use for manual pumping operation.

BRIEF DESCRIPTION OF THE DRAWINGS

The aforementioned objects and advantages of the present invention, as well as additional objects and advantages thereof will be more fully understood hereinafter as a result of a detailed description of a preferred embodiment when taken in conjunction with the accompanying drawings in which.

DETAILED DESCRIPTION OF A PREFERRED EMBODIMENT

Figure 1:
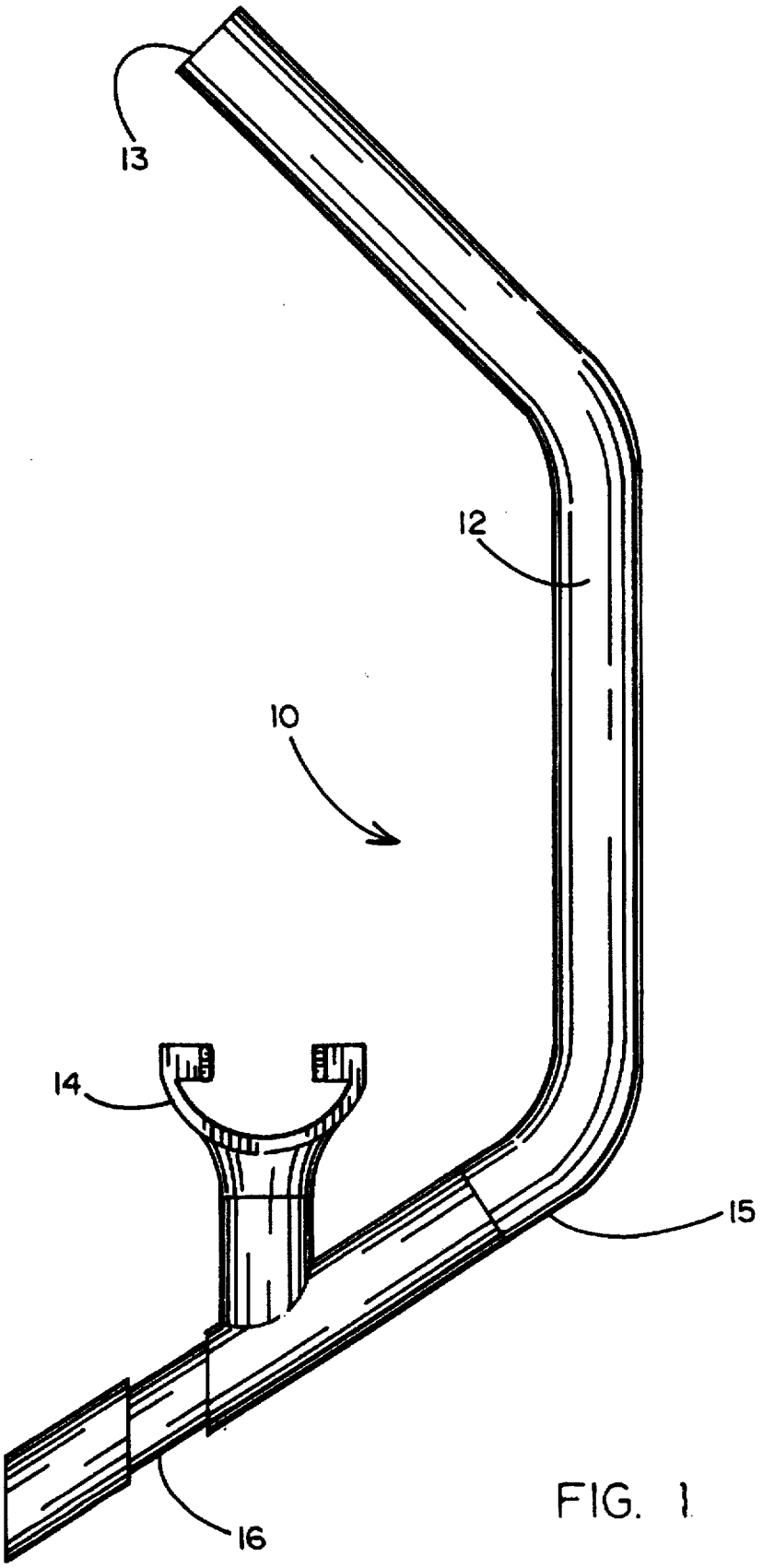
FIG. 1 is a three-dimensional view of a snorkel having a pump in accordance with the invention.
Figure 2:
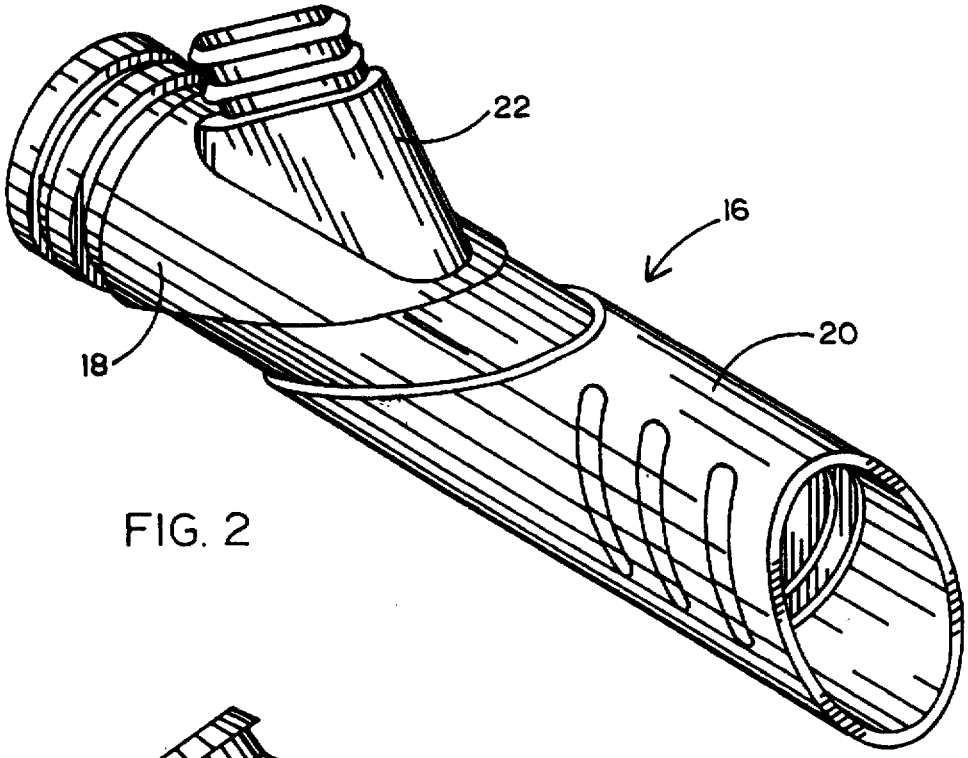
FIG. 2 is a three-dimensional view of the pump portion of the snorkel of FIG. 1.
Figure 3:
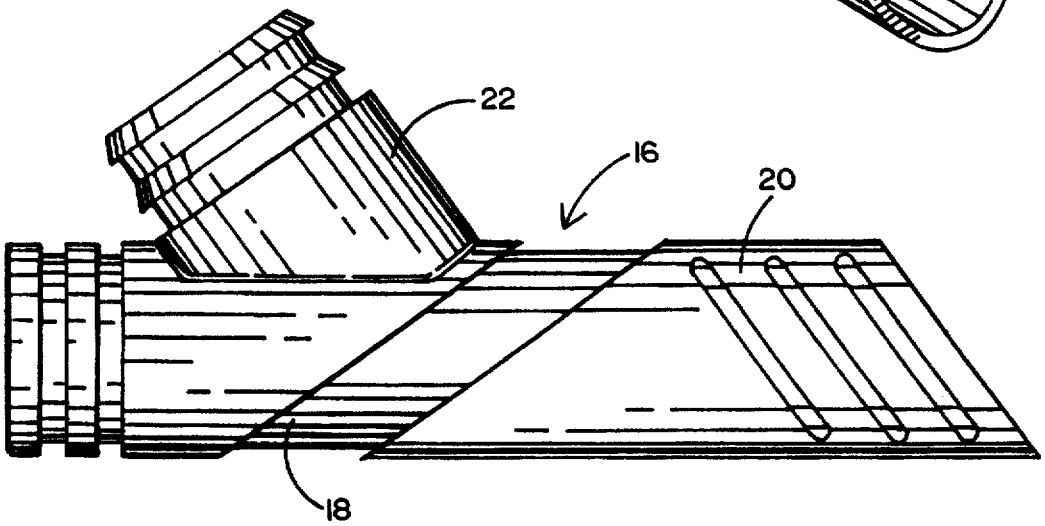
FIG. 3 is an elevational front view of the preferred embodiment of the pump.
Figure 4:
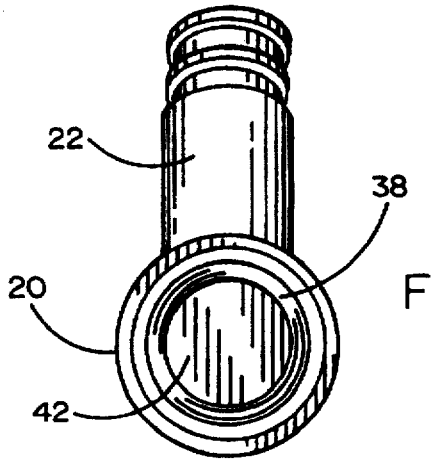
FIG. 4 is an elevational end view of the preferred embodiment of the pump.

Referring to the accompanying Figures, it will be seen that a pump snorkel 10, in accordance with the present invention, comprises a snorkel tube 12 having an upper open end 13 and a lower end 15, the latter connected to a pump 16 which, in turn, provides a mouthpiece 14.

Pump 16 comprises a fixed tubular member 18 and a moveable tubular member 20. Fixed tubular member 18 is provided with a diagonally extending mouthpiece support 22 which is configured to receive mouthpiece 14.

Figure 5:
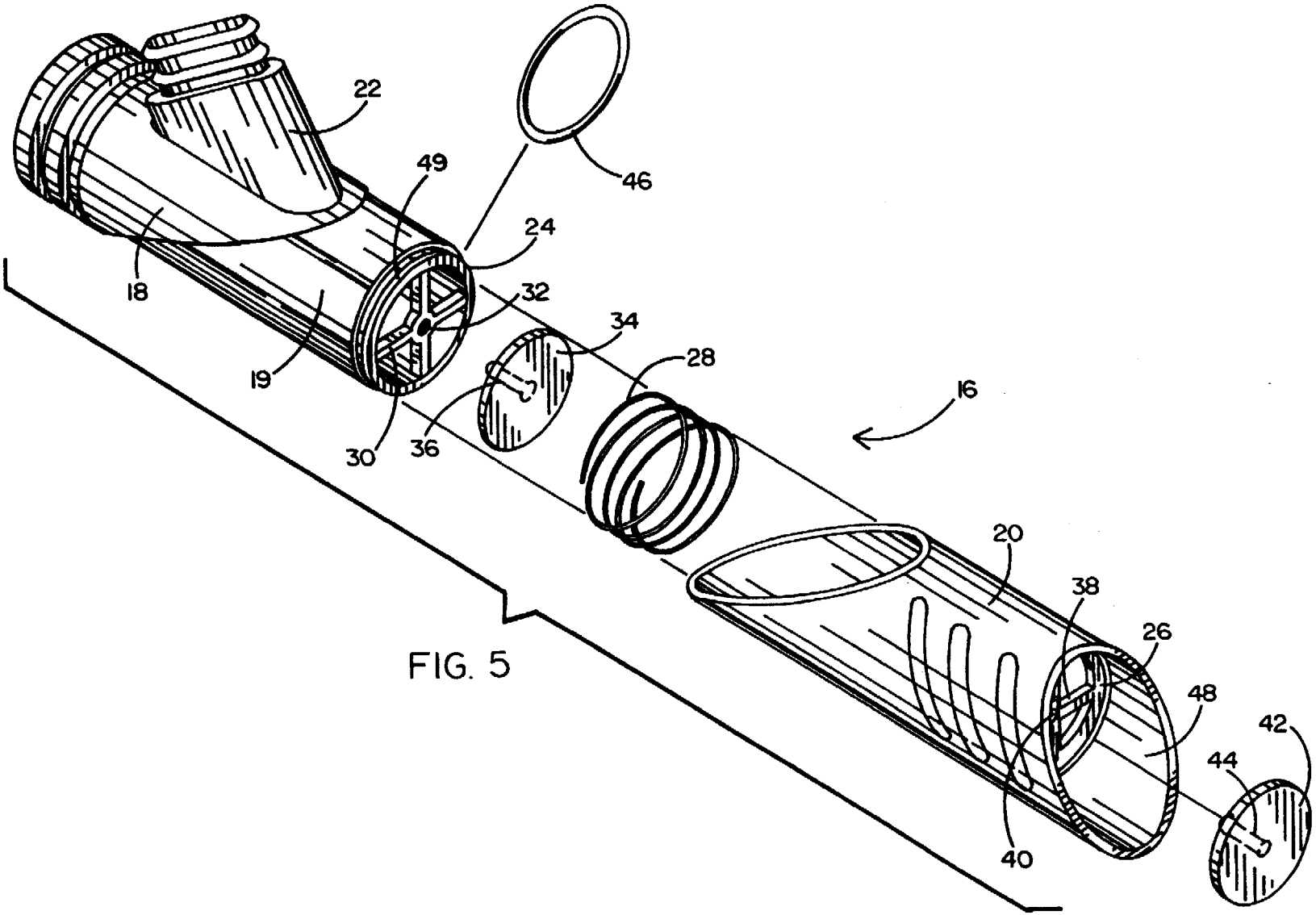
FIG. 5 is an exploded view of the pump.
Figure 6:
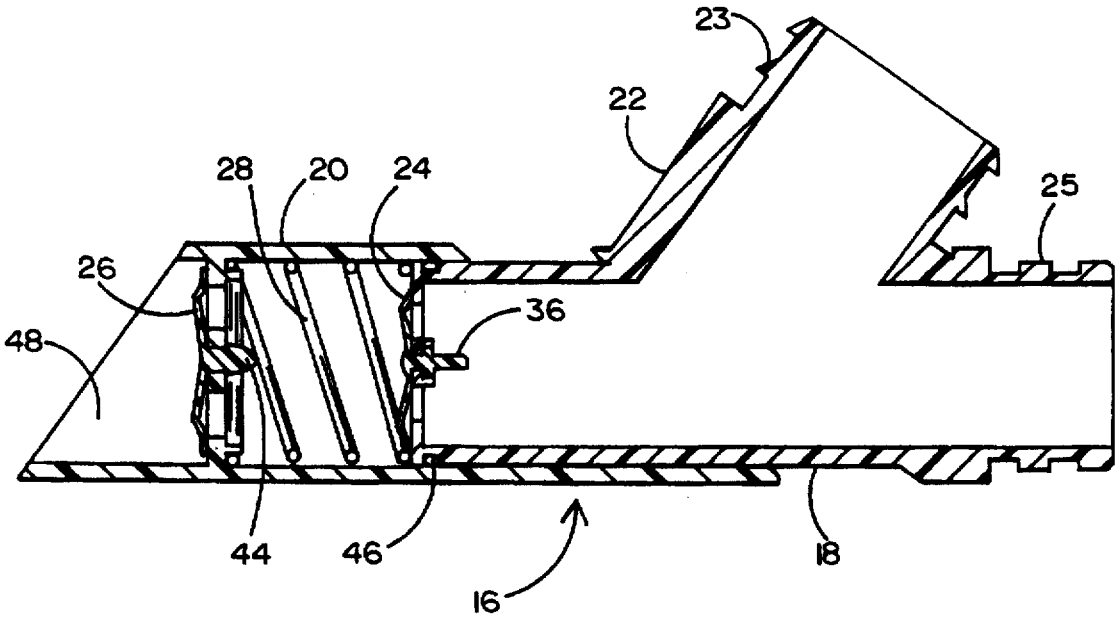
FIG. 6 is a cross-sectional view of the pump shown in its fully extended configuration.
Figure 7:
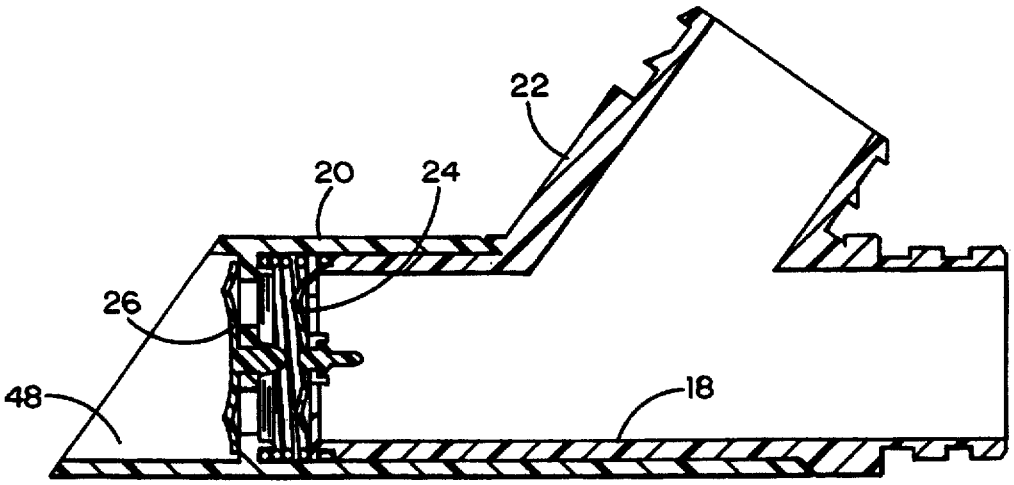
FIG. 7 is a cross-sectional view of the pump shown in its fully compressed configuration.

As seen best in FIGS. 5–7, pump 16 also comprises a pair of valves 24 and 26, as well as a spring 28. Each such valve is a one-way mushroom valve permitting water flow only in a direction away from the mouthpiece 14 to be expelled at a pump exit 48. Valve 24 comprises a frame 30 having a central aperture 32 for receiving a flexible valve flap 34 which is secured to the frame aperture 32 by a probe-like protrusion 36. Similarly, valve 26 comprises a frame 38 having a central aperture 40 for receiving a flexible valve flap 42 which is secured to the frame aperture 40 by a probe-like protrusion 44.

Fixed tubular member 18 has a reduced diameter section 19 over which moveable tubular member 20 is coaxially seated for limited slidable engagement therewith. An O-ring 46 is provided in a slot 49 at the valve end of reduced diameter section 19 to prevent water from entering the pump 16 and to allow creation of a suction effect in the pump to withdraw the collected water from the region of the mouthpiece support 22.

Operation of the pump 16 is depicted in FIGS. 6 and 7. For purposes of clarity, pump 16 is shown without mouthpiece 14 and snorkel tube 12 connected at ridged ends 23 and 25, respectively. When pump 16 is pumped by moving tubular member 20 toward the mouthpiece support 22, spring 28 is compressed and valve 26 opens while valve 24 remains closed. When the pump force is removed, spring 28 moves tubular member 20 away from mouthpiece support 22 closing valve 26 and opening valve 24. This latter motion effectively sucks water out of the mouthpiece region and into the moveable tubular member while the former motion forces that water out through valve 26 and pump exit 48. Repeated reciprocal motion between the pump positions of FIGS. 6 and 7 will ultimately remove substantially all of the water collected adjacent the mouthpiece.

It will now be understood that what has been disclosed herein comprises a novel snorkel device, namely, a snorkel pump for removing collected water adjacent the mouthpiece of a snorkel. Those having skill in the relevant art will now, as a result of the disclosure of a preferred embodiment, perceive various modifications and additions which may be made to the invention. By way of example, the pump may be configured as an add-on to existing snorkel tubes having a mouthpiece and a lower drainage valve. In addition, other types of valves may be used in place of the valves shown herein. Accordingly, all such modifications and additions are deemed to be within the scope of the invention which is to be limited only by the appended claims and their equivalents.

We claim:

1. In a snorkel of the type having an elongated tube having an open end for entry of air and exit of expelled water and having a mouthpiece; a pump in fluid communication with the mouthpiece for removing water therefrom and comprising:

a fixed tubular member extending coaxially from said tube adjacent said mouthpiece;

a moveable tubular member in coaxial slidable engagement with said fixed member;

a first valve located in said fixed tubular member for permitting water flow in only a unitary direction away from said mouthpiece;

a second valve located in said moveable tubular member for permitting water flow in only a unitary direction away from said mouthpiece; and a compression spring positioned in said moveable tubular member for compression upon movement of said moveable tubular member toward said mouthpiece and extension upon movement of said moveable tubular member away from said mouthpiece;

whereby compression and expansion of said spring removes water from said mouthpiece.

2. A snorkel comprising:

an elongated tube having a mouthpiece extending therefrom between ends of said tube; and a pump forming a coaxial exit end of said tube adjacent said mouthpiece for removing water collected near said mouthpiece, said pump having an axially moveable tubular portion and a pair of one-way valves, one of said valves being positioned in said tube and the other of said valves being positioned in said tubular portion for suction of water away from said mouthpiece and toward said exit end upon reciprocal axial motion of said axially moveable tubular portion.

3. The snorkel recited in claim 2 further comprising a compression spring located in said tubular portion for resisting motion of said tubular portion toward said mouthpiece.

4. The snorkel recited in claim 2 wherein at least one of said valves is a mushroom valve.

5. A pump for use with a snorkel tube to remove water collected in the tube; the pump comprising:

a pair of overlapping coaxial tube sections in relative slidable engagement and having a pair of one-way valves for suctioning water in a selected direction upon reciprocal motion of said tube sections, both of said tube sections being adapted for coaxial fluid communication with said snorkel tube.

6. The pump recited in claim 5 wherein at least one of said one-way valves is a mushroom valve.

7. The pump recited in claim 5 further comprising a compression spring positioned between said one-way valves for resisting said reciprocal motion.

8. The pump recited in claim 5 further comprising a mouthpiece extending from one of said tube sections.

9. The pump recited in claim 5 further comprising an O-ring positioned on opposed radial surfaces of said tube sections for preventing the flow of water therebetween.

* * * * *